US006162980A

United States Patent [19]

Kitashima et al.

[11] Patent Number: 6,162,980

[45] **Date of Patent: *Dec. 19, 2000**

[54] ELECTRONIC UPRIGHT PIANO AND A METHOD OF MANUFACTURE THEREOF

[75] Inventors: Riichi Kitashima, Shizuoka-ken; Muneo Ishida, Hamamatsu; Masaji Kimura, Hamamatsu; Shinichiro Miwa, Hamamatsu, all of Japan

[73] Assignee: Kabushiki Kaisha Kawai Gakki Seisakusho, Hamamatsu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/750,731

[22] PCT Filed: Apr. 25, 1996

[86] PCT No.: PCT/JP96/01160

§ 371 Date: Dec. 17, 1996

§ 102(e) Date: Dec. 17, 1996

[87] PCT Pub. No.: WO96/34380

PCT Pub. Date: Oct. 31, 1996

[30] Foreign Application Priority Data

Apr. 26, 1995 [JP] Japan ..... 7-102181
Jun. 2, 1995 [JP] Japan ..... 7-136740

[51] Int. Cl.[7] ..... G10C 3/12

[52] U.S. Cl. ..... 84/423 R; 84/170; 84/171; 84/220; 84/438; 84/615

[58] Field of Search ..... 84/423 R, 171, 84/170, 220, 615, 438

[56] References Cited

U.S. PATENT DOCUMENTS

| | | | |
|---|---|---|---|
| 877,603 | 1/1908 | Smith | 84/220 |
| 5,247,129 | 9/1993 | Nozaki et al. | 84/615 |
| 5,287,787 | 2/1994 | Satoshi | 84/240 |
| 5,386,083 | 1/1995 | Kawamura | 84/719 |

FOREIGN PATENT DOCUMENTS

| | | |
|---|---|---|
| 4347895 | 12/1992 | Japan . |
| 529091 | 4/1993 | Japan . |

OTHER PUBLICATIONS

Reblitz, Piano Servicing, Tuning, and Rebuilding for the Professional, the Student, and the Hobbyist 1993, The Vertal Press.

*Primary Examiner*—David Martin
*Assistant Examiner*—Shih-yung Hsieh
*Attorney, Agent, or Firm*—Davis and Bujold

[57] ABSTRACT

To provide an electronic upright piano providing a key touch of an acoustic upright piano. An action load simulation member (2) provided in the electronic upright piano is composed of a wippen (15) rotating and rising when a depressed key (11) is rotated, a jack (17) rising together with the wippen (15) until a jack tail **(17*a*) contacts a regulating button (16), a hammer butt (18) rotatably supported by a center pin (18*b*) for contacting or leaving the jack (17), a hammer shank (21) connected to the hammer butt (18) and provided with a hammer (23), and a hammer stopper (32) which can contact the tip of the hammer (23). The wippen (15), the jack (17) and the hammer butt (18)** are rotated about separate axes, respectively. In the electronic upright piano, the let-off timing is the same as that in an acoustic upright piano.

10 Claims, 18 Drawing Sheets

ELECTRONIC UPRIGHT PIANO AND A METHOD OF MANUFACTURE THEREOF

TECHNICAL FIELD

The invention relates to an electronic upright piano provided with an action load simulation member providing an action simulating load onto a keyboard.

BACKGROUND OF THE INVENTION

Conventionally, in an electronic piano, electronic sound is issued from a loudspeaker, in response to an player's depressing or releasing a key or keys. Recently, such electronic sound was improved to reach a highly desirable level. The feel of the keys on the electronic keyboard has also been improved in various ways, in order to reach the feel of the keys of an acoustic piano.

Specifically, an electronic piano provided with an action load simulation member is developed, such that the touch of the keys approaches the touch of the keys of an acoustic upright piano. As shown in FIG. 9, such electronic piano is provided with a hammer arm P14 rotatable about a shaft P10 for depressing the rear end of a key P12. As shown in FIG. 10, another electronic piano is provided with a hammer arm P20 rotatable about a shaft P16 for pushing up a key P18, such that the tip of the key 18 is raised (refer to the Japanese Patent Application laid-open No.4-347895). The action load simulation members shown in FIGS. 9 and 10 are developed for use in an electronic upright piano, having a low roof top height, such that almost acoustic piano sound can be generated.

The key touch on the acoustic upright piano is now explained. As shown in FIG. 11, when a player depresses a key 111, a wippen 115 is rotated in the direction opposite to the rotary direction of the key 111 (counterclockwise as viewed in the figure) and is raised, and a jack 117, rotatably attached to the wippen 115, is raised to push up a hammer butt 118. The hammer butt 118 is in turn rotated together with a hammer shank 121 and a hammer head 123 in the direction opposite to the rotary direction of the key 111 (counterclockwise as viewed in the figure). The jack 117 is raised to a predetermined position where a jack tail 117*a* contacts the bottom of a regulating button 116, and is then released from the hammer butt 118. Consequently, the hammer butt 118, the hammer shank 121 and the hammer head 123 continued to be inertially rotated, thereby striking a string.

As aforementioned, in the acoustic upright piano, the wippen 115, the jack 117 and the hammer butt 118 are rotated about different axes, respectively. In addition, the jack 117 leaves the hammer butt 118 at a specified timing. The touch of the key 111 is complicated.

However, in the action load simulation member shown in FIG. 9 or FIG. 10, a dead weight is rotated about an axis. Therefore, the key touch is simpler as compared with the key touch of the acoustic upright piano.

DISCLOSURE OF THE INVENTION

The present invention has been developed to solve the aforementioned problem, and an object of the first aspect of the present invention is to provide an electronic upright piano providing a touch of keys of an acoustic upright piano. An object of the second aspect of the present invention is to provide a method of mass production of the electronic upright piano according to the first aspect of the present invention.

To attain the aforementioned object, the fist aspect of the present invention provides an electronic upright piano provided with an action load simulation member for applying an action simulating load to a keyboard.

The action load simulation member is composed of

- a wippen equivalent member rotatably attached to a piano body for rotating when a key is depressed and rotated,
- a jack equivalent member rotatably attached to the wippen equivalent member for rising when the key is depressed and the wippen equivalent member is rotated,
- a hammer equivalent member for being pushed up by the jack equivalent member and being rotated, while the jack equivalent member is rising to a predetermined position, and leaving the jack equivalent member and moving inertially after the jack equivalent member reaches the predetermined position, and
- a stopper for contacting the inertially moving hammer equivalent member, thereby stopping the movement of the hammer equivalent member.

The hammer equivalent member can be rotatably attached to the piano body and can be provided with a butt part for contacting and leaving the jack equivalent member, a bar-like hammer shank part connected to the butt part and a hammer part attached to the hammer shank part.

Further, a cushion member can be interposed between the stopper and the hammer equivalent member.

The electronic upright piano can be covered with a case identical to the case of the acoustic upright piano.

The second aspect of the present invention provides a method of manufacturing the electronic upright piano according to the first aspect of the present invention, provided with an action unit composed of the wippen equivalent member, the jack equivalent member and the hammer equivalent member integrally incorporated in the action unit.

The electronic upright piano according to the first aspect of the invention is provided with the action load simulation member for applying an action simulating load to the keyboard. The action load simulation member is composed of the wippen equivalent member, the jack equivalent member, the hammer equivalent member and the stopper. When the player depresses the key and the key is rotated, the wippen equivalent member is rotated, and the jack equivalent member is raised. While the jack equivalent member is rising to a predetermined position, the hammer equivalent member is pushed up by the jack equivalent member and is rotated. After the jack equivalent member reaches the predetermined position, the hammer equivalent member is released from the jack equivalent member and is inertially moved. The stopper contacts the inertially moving hammer equivalent member, thereby stopping the inertial movement of the hammer equivalent member.

The action load simulation member acts in the same manner as the action mechanism of an acoustic upright piano, except that no string is struck. Therefore, the player can obtain the key touch similar to that of an acoustic upright piano at the time of key depression.

When the hammer equivalent member is composed of the butt part, the hammer shank part and the hammer part in the same manner as in an acoustic upright piano, the aforementioned effectiveness becomes more remarkable.

When the cushion member is interposed between the stopper and the hammer equivalent member, any shock resulting from the contact of the stopper and the hammer equivalent member can be absorbed by the cushion member. Therefore, no unusual noise can be made at key depression.

When the electronic upright piano is provided with the case of an acoustic upright piano, different from any conventional electronic piano, the electronic upright piano can be almost the same as the acoustic upright piano in appearance and key touch. The conventional electronic piano has a lower roof-top height, lacks strong impression and provides little aesthetic atmosphere. This respect is improved in the electronic upright piano according to the present invention. Furthermore, since no string is provided inside, thereby obviating the necessity of frames, support members or other weight members, the electronic upright piano can be lightened, as compared with an acoustic piano.

In the method of manufacturing the electronic upright piano according to the second aspect of the present invention, the action unit integrally incorporating the wippen equivalent member, the jack equivalent member and the hammer equivalent member is used. For example, first a key bed is attached between both arms and a keyboard, and cheek blocks are mounted on the key bed and, subsequently, the action unit is secured to the key bed. Alternatively, after the key bed, the keyboard and the action unit are integrally assembled, the assembly is attached between both arms and finally the cheek blocks are mounted. The action unit can be provided with the stopper. In the method according to the second aspect of the present invention, electronic upright pianos can be produced inexpensively in a mass.

BEST MODE FOR PRACTICING THE INVENTION

Figure 1:
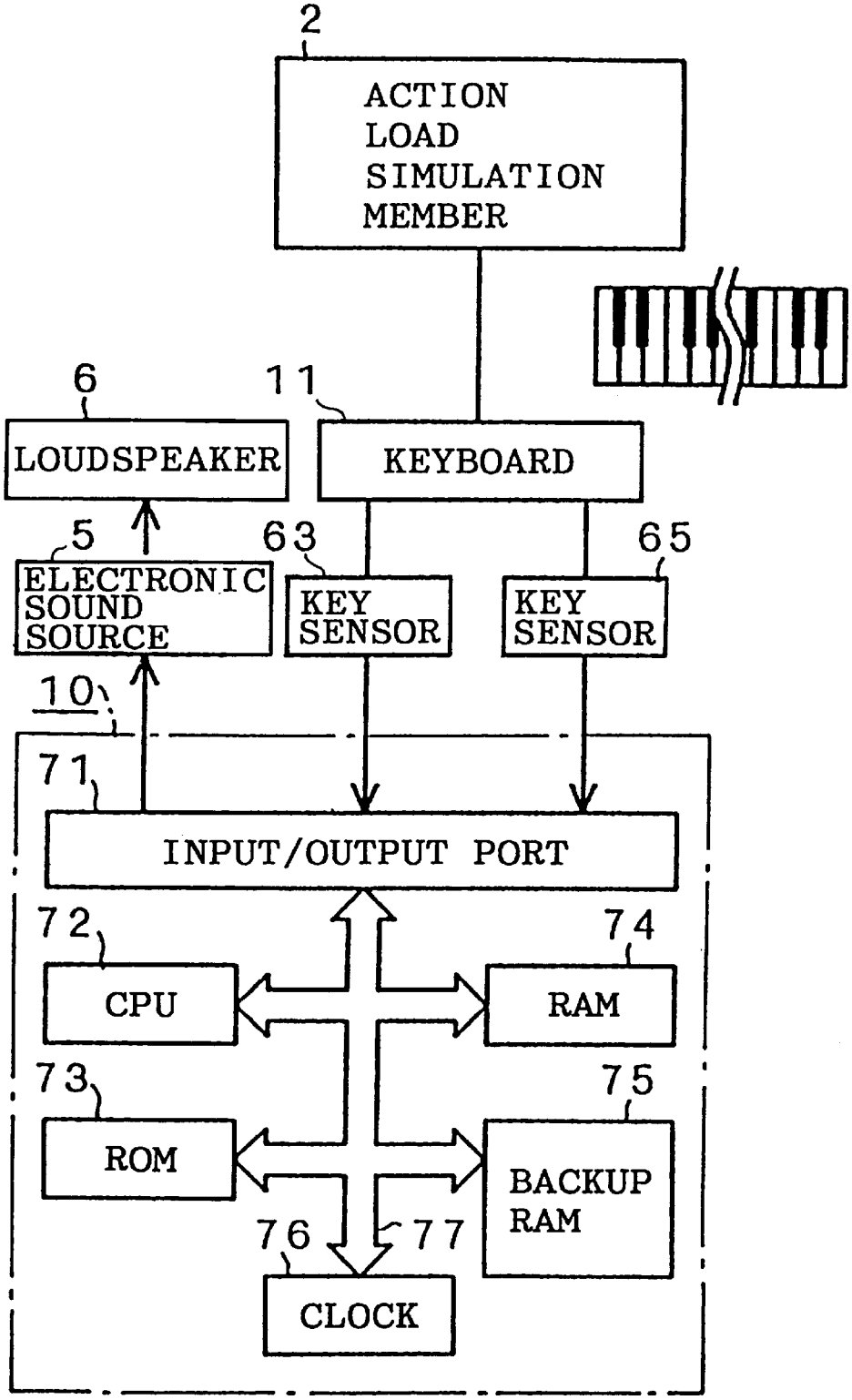
FIG. 1 is a diagrammatic representation of an electronic upright piano according to the first embodiment of the present invention.

Preferred embodiments of the present invention are now explained, referring to the drawing figures.

Figure 2:
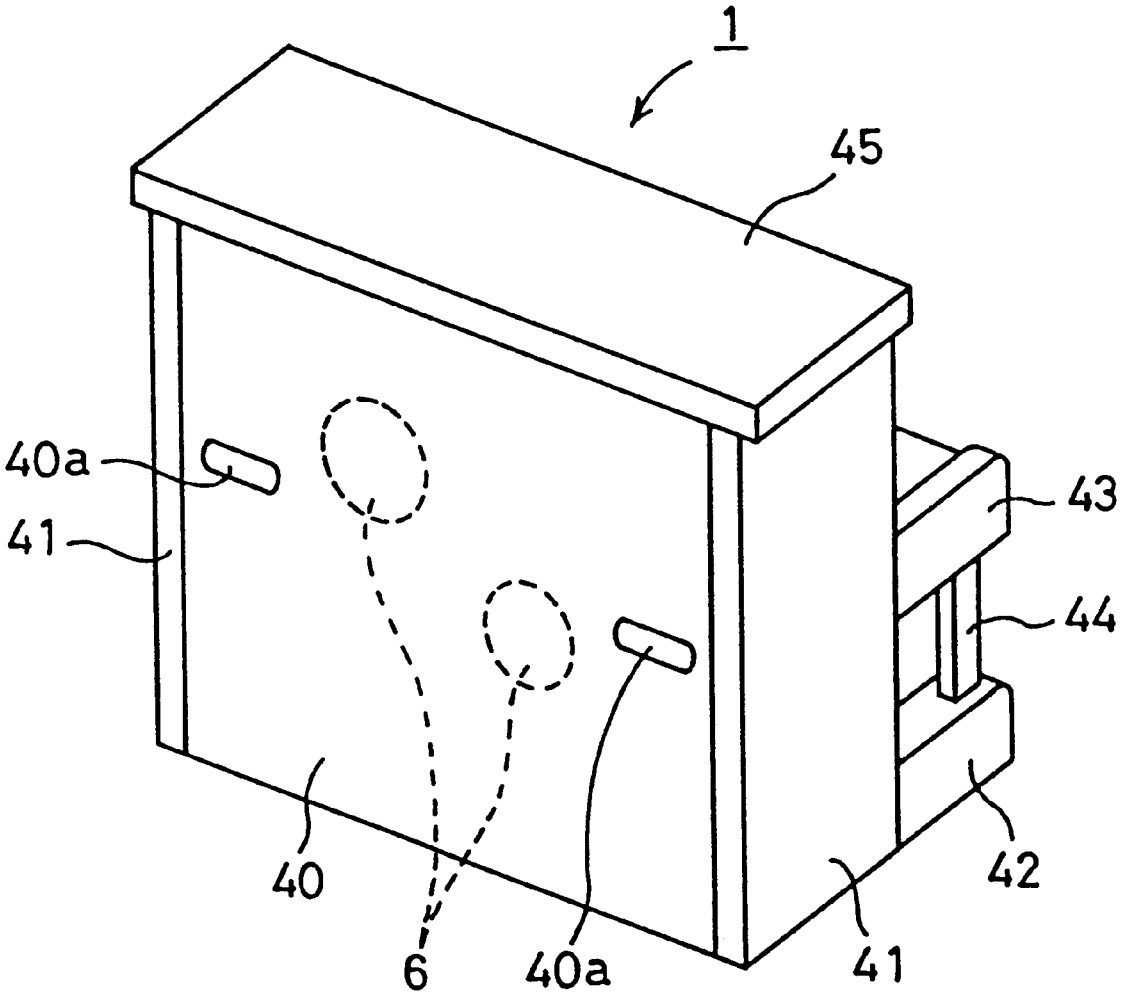
FIG. 2 is an explanatory view of the electronic upright piano of the first embodiment.
Figure 3:
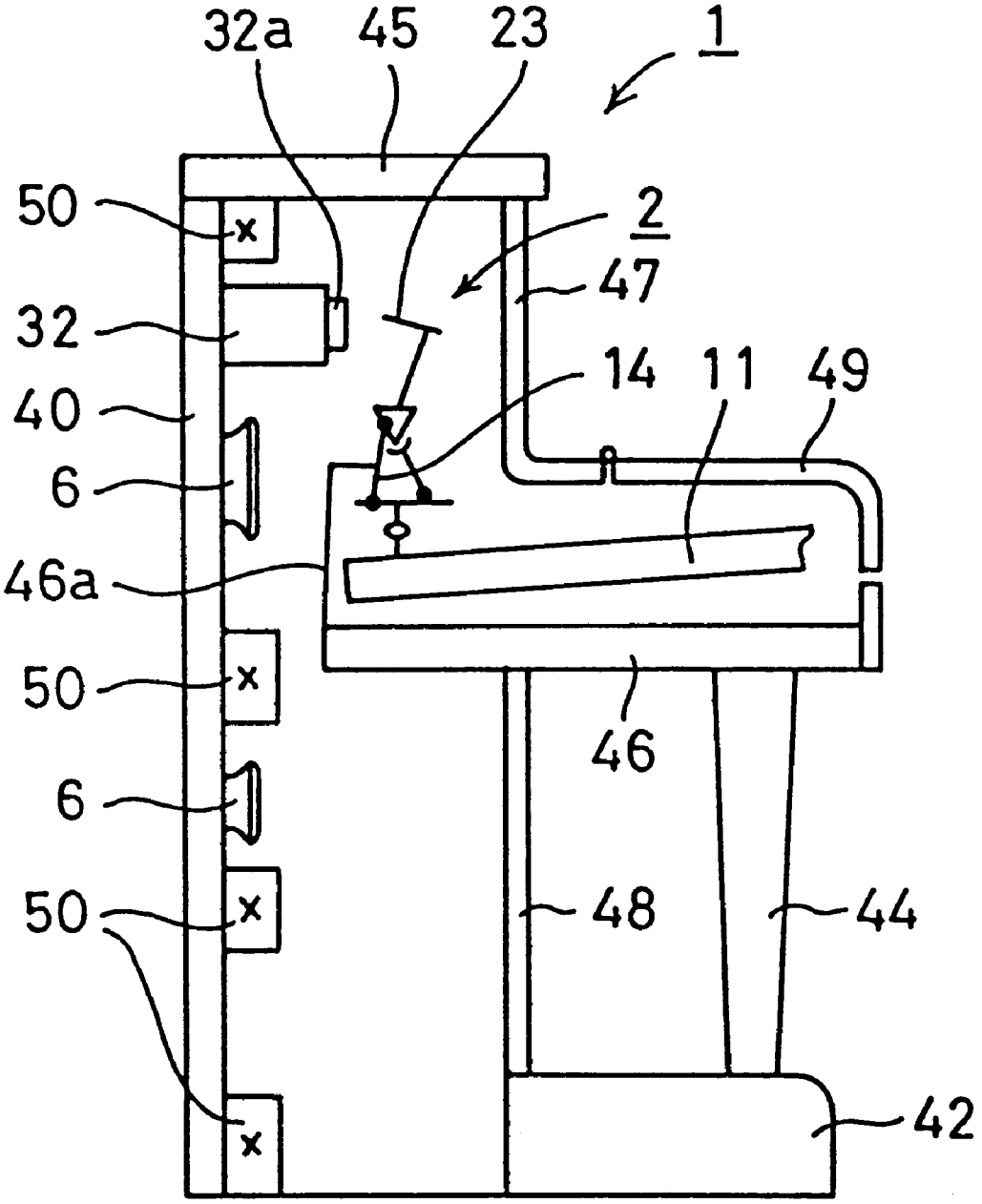
FIG. 3 is an elevated cross sectional view of the electronic upright piano of the first embodiment.
Figure 4:
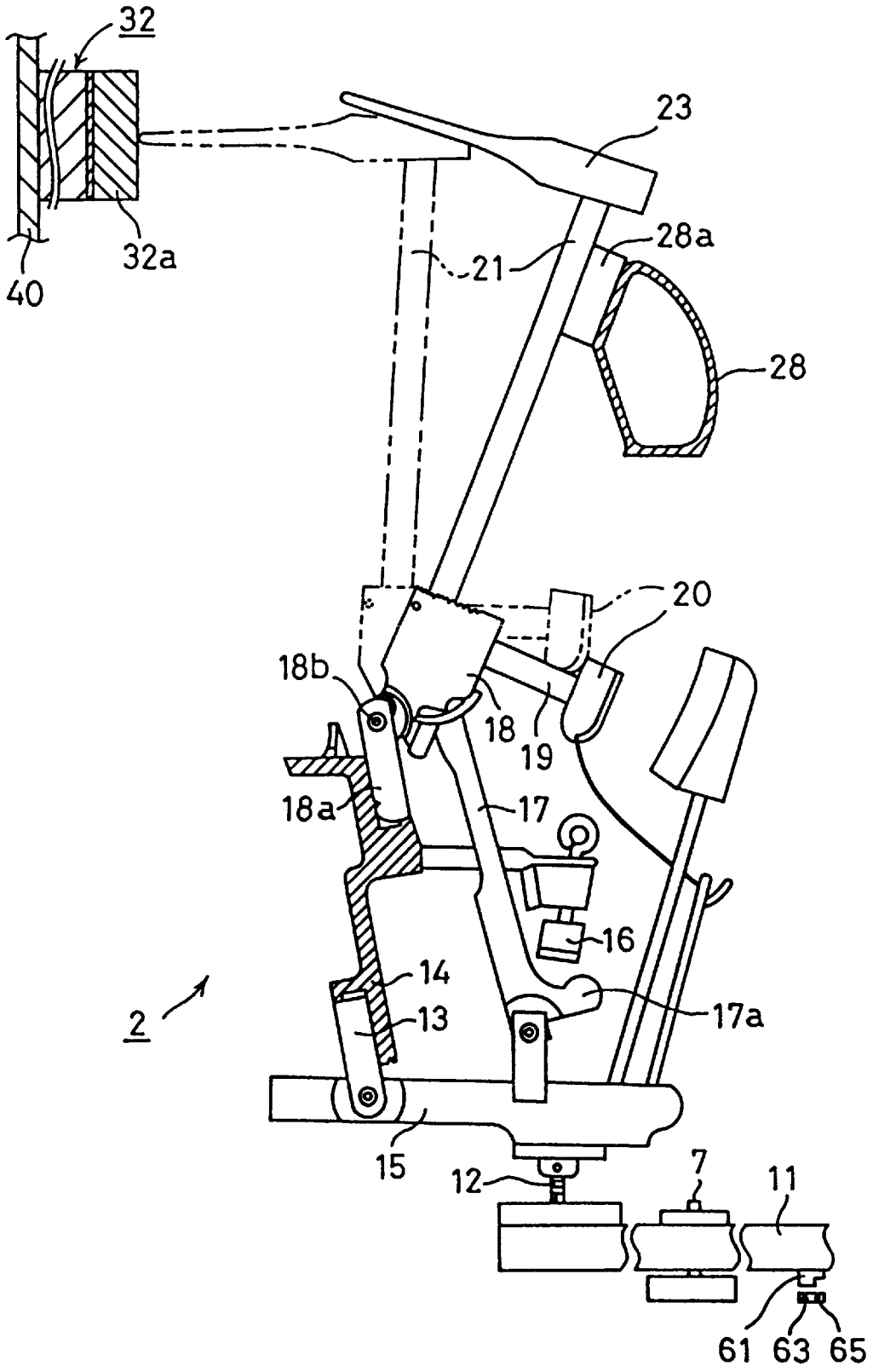
FIG. 4 is an explanatory view of an action load simulation member of the first embodiment.

FIG. 1 is a diagrammatic representation of an electronic upright piano according to the first embodiment, FIG. 2 is an explanatory view of the electronic upright piano of the first embodiment, FIG. 3 is an elevated cross sectional view of the electronic upright piano of the first embodiment, and FIG. 4 is an explanatory view of an action load simulation member of the first embodiment As shown in FIG. 1, an electronic upright piano 1 of the first embodiment is provided with an action load simulation member 2, keys 11, key sensors 63, 65, a control unit 10, an electronic sound source 5 and a loudspeaker 6. The case of the electronic upright piano 1 is, as shown in FIGS. 2 and 3, composed of a pair of opposite end panels 41, toe blocks 42 and arms 43 extending forward from the end panels 41, legs 44 vertically extended between the toe blocks 42 and the arms 43, a roof panel 45 horizontally extended between the end panels 41, a key bed 46 supported by the legs 44 for bearing the keys 11, an upper frame 47 and a bottom frame 48 for covering the front of the electronic upright piano 1, a fallboard 49 connected to the upper frame 47 and a rear plate 40 for covering the rear of the electronic upright piano 1. The case, finished with mat black paint, is almost identical to the case of an acoustic upright piano. The rear plate 40 is made of lauan plywood and is provided with a pair of lift holes 40*a*.

As shown in FIG. 4, an action load simulation member 2 is composed of a capstan button 12 raised when the key 11 is rotated clockwise, as viewed in the figure, about a balance pin 7, a wippen 15 rotatably supported via a flange 13 on a center rail 14 for rotating in the direction opposite to the rotary direction of the key 11 when the capstan button 12 is raised, a jack 17 rotatably connected to the wippen 15 for rising together with the wippen 15 until a jack tail 17*a* contacts a regulating button 16, a hammer butt 18 rotatably supported by a center pin 18*b* of a butt flange 18*a* secured to the center rail 14 for contacting and leaving the jack 17, a hammer shank 21 connected to the hammer butt 18 for rotating in the direction opposite to the rotary direction of the key 11 when the hammer butt 18 is pushed up by the jack 17, a catcher shank 19 extended perpendicular to the hammer shank 21 from the hammer butt 18, a catcher 20 attached to the tip of the catcher shank 19, a hammer 23 attached to the tip of the hammer shank 21, a hammer stopper 32 for contacting the tip of the hammer 23, and a hammer rail 28 having a cushion material 28*a* for contacting the side of hammer shank 21 struck back after the hammer 23 strikes the hammer stopper 32 and absorbing the vibration of the hammer 23.

The center rail 14 is secured via a support member 46*a* above the inner end of the key bed 46 (refer to FIG. 3).

Different from an acoustic upright piano, the hammer 23 has no hammer felt attached thereto. However, the center of gravity of the hammer is determined by taking consideration of the weight of the hammer felt.

The hammer stopper 32 is attached to a predetermined position of rear plate 40 such that the hammer stopper 32 can contact the tip of the hammer 23. When the hammer butt 18 is pushed upwards by the jack 17, the hammer 23 starts rotating counterclockwise as seen in FIG. 4. Even after the jack 17 leaves the hammer butt 18, the hammer 23 continues inertially rotating counterclockwise. The hammer stopper 32 is positioned such that it can contact the tip of the inertially rotating hammer 23, thereby stopping the movement of the hammer 23. The hammer stopper 32 is provided with a cushion material 32*a* for absorbing any shock resulting from the contact with the hammer 23. The cushion material is formed of, for example, rubber, resin, cloth, cotton, paper or the like.

A stepped shutter 61 having a two-stepped bottom face is attached to the bottom face of the key 11, and is swung vertically when the key 11 is rotated about the balance pin 7.

The key sensors 63, 65 are provided under the key 11 for detecting the key depression or release, and are each composed of a pair of light emitting and receiving elements having a light path extended therebetween. The key sensors 63, 65 are photo interrupters outputting ON signal when the light path is interrupted by the stepped shutter 61. Specifically, when the key 11 is depressed, the light path in the key sensor 63 is interrupted, thereby outputting ON signal. Subsequently, after a specified time interval, the light path in the key sensor 65 is interrupted, thereby outputting ON signal. As shown in FIG. 1, the key sensors 63, 65 are connected to the control unit 10.

As shown in FIG. 1, the control unit 10 is an arithmetic logic circuit including an input/output port 71, CPU 72, ROM 73, RAM 74, backed-up RAM 75, clock 76 and other. These components are interconnected via a bus 77. The control unit 10 is connected via the input/output port 71 to the key sensors 63, 65, and is connected via the input/output port 71 to the electronic sound source 5. Timings at which the light paths in the key sensor 63 and 65 are interrupted and a time difference between the timings are detected in CPU 72, and the detected timings and time difference are temporarily stored in RAM 74. Based on the control program stored in ROM 73, signal is transmitted to the electronic sound source 5. Additionally, a pedal sensor (not shown) is connected to the control unit 10 for detecting the movement of the pedal mechanism including a damper pedal, a soft pedal and other. By additionally taking the detected movement of the pedal mechanism into consideration, signal is transmitted to the electronic sound source 5.

The electronic sound source 5 is provided with a storing part (not shown) for storing acoustic piano sound or string striking sound and a reproduction part (not shown) for reading sound from the storing part, and is secured to the inner bottom face of the piano, for emitting sound via the loudspeaker to the outside. As shown in FIG. 3, the loudspeaker 6 is provided on the rear plate 40, facing forward to the player.

Figure 5:
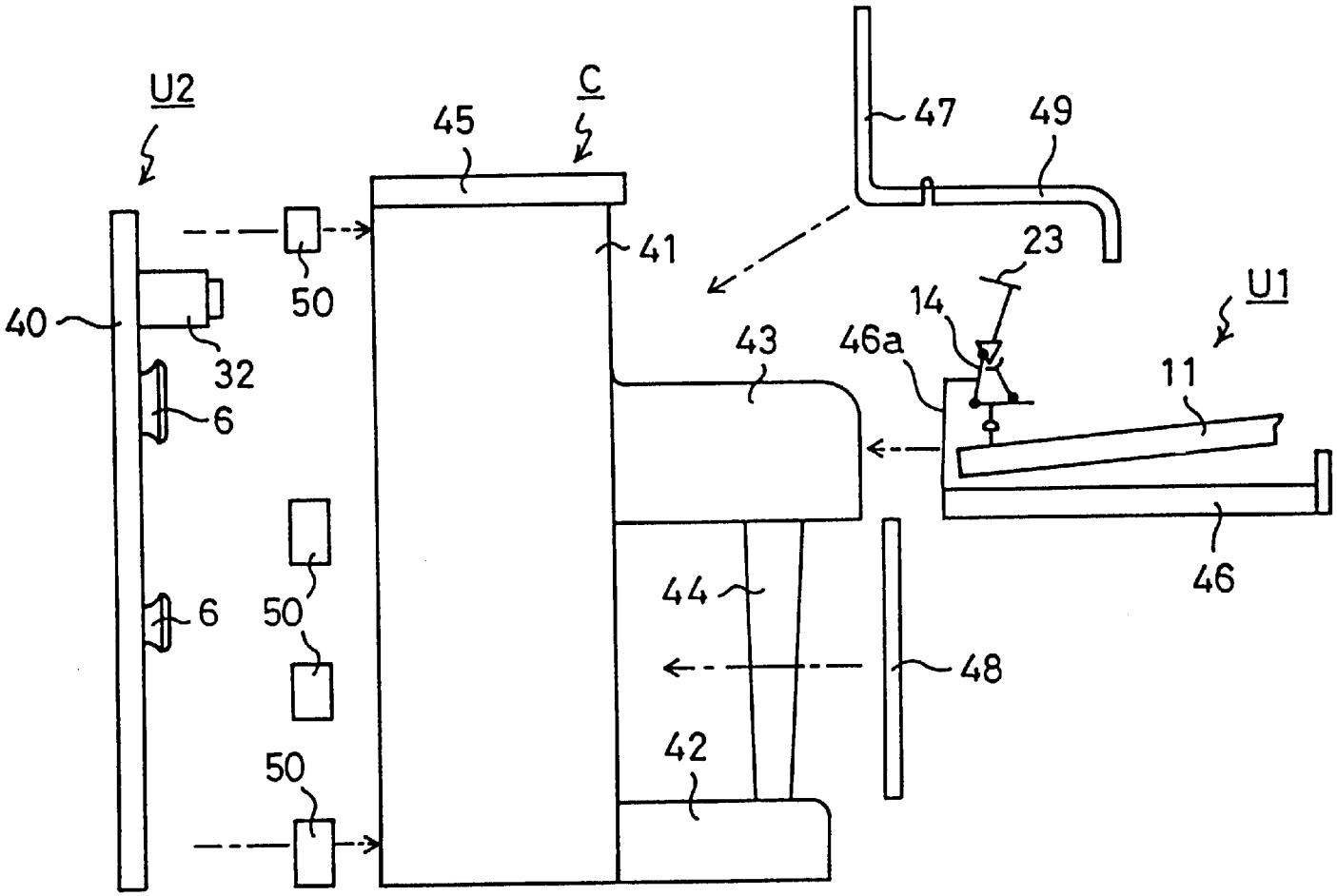
FIG. 5 is an explanatory view showing the assembly of the electronic upright piano of the first embodiment.

When assembling the electronic upright piano 1, as shown in FIG. 5, first the toe blocks 42, the arms 43 and the legs 44 are attached to the opposite end panels 41, respectively. By mounting the roof panel 45 also to the end panels 41, a cabinet C is completed. On the other hand, the center rail 14 supporting the wippen 15, the jack 17, the hammer butt 18 and the associated components is attached via the support member 46*a* to the key bed 46. By further disposing the keys 11 onto the key bed 46, a key bed unit U1 (corresponding to the action unit of the present invention) is completed. The hammer stopper 32 and the loudspeaker 6 is attached to the rear plate 40, thereby completing a rear plate unit U2. Subsequently, the key bed unit U1 and the rear plate unit U2 are assembled to the cabinet C. The rear plate unit U2 is first attached via attachment blocks 50 to the end panels 41 of the cabinet C. Finally, the upper frame 41, the fallboard 49 and the bottom frame 48 are attached to the cabinet C, thereby completing the electronic upright piano 1 of the first embodiment.

The operation of electronic upright piano 1 having the aforementioned construction is now explained.

As shown in FIG. 4, when the player depresses any key 11, the wippen 15 is rotated in the direction opposite to the rotation direction of key 11 (counterclockwise as seen in the figure). The jack 17 is then raised, pushing upwards the hammer butt 18. Subsequently, the hammer butt 18 is rotated together with the hammer shank 21 and the hammer 23 in the direction opposite to the rotation direction of the key 11 (counterclockwise as seen in the figure). When the jack 17 reaches the predetermined position, the jack tail 17*a* contacts the regulating button 16, and the jack 17 is largely rotated in the rotation direction of the key 11 (clockwise as seen in the figure), leaving the hammer butt 18. The hammer butt 18 is then allowed to move inertially together with the hammer shank 21 and the hammer 23. Subsequently, the tip of the hammer 23 strikes the hammer stopper 32 and is stopped.

Figure 6:
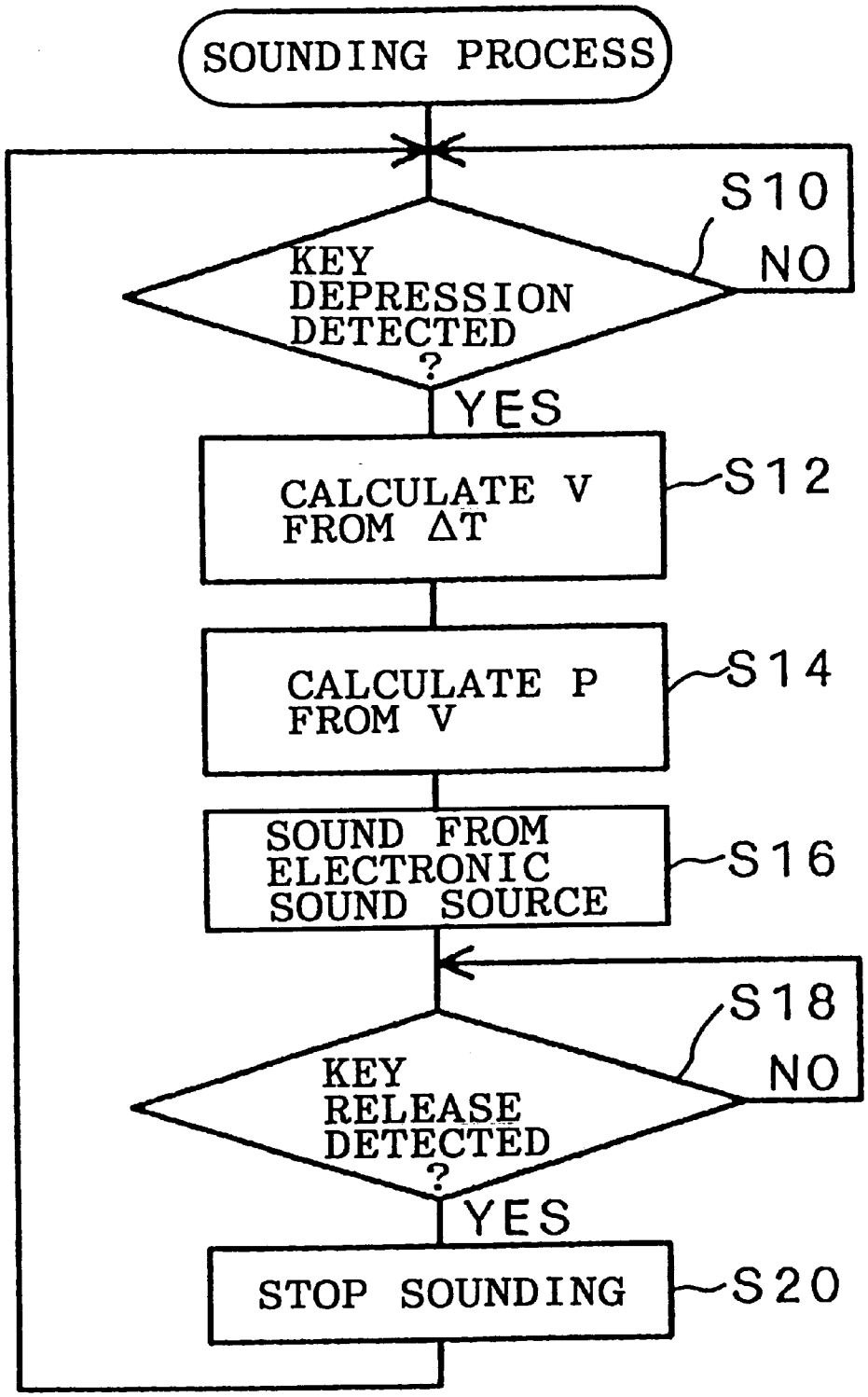
FIG. 6 is a flowchart for sounding process.

When the action load simulation member 2 is operated as aforementioned, the light path in key sensors 63, 65 is interrupted by the stepped shutter 61. The CPU 72 of the control unit 10 executes a sounding process, which is one of the control programs stored in ROM 73. The sounding process is now explained referring to the flowchart in FIG. 6.

After the process starts, it is first determined whether or not the key depression is detected by the key sensors 63, 65 (S10). After an ON signal is transmitted from the key sensor 63 to the control unit 10, if another ON signal is transmitted from the key sensor 65 to the control unit 10, it is determined that the key depression is detected. If at step S10 no key depression is detected (NO at S10), the process step goes back to S10. If the key depression is detected at step S10 (YES at S10), a key depression velocity V is calculated from a time difference $\Delta T$ between the time when ON signal is transmitted from the key sensor 63 and the time when ON signal is transmitted from the key sensor 65, for example, by using the following formula (S12).

$V \leftarrow K/\Delta T$ (K is a constant)

Subsequently, a key depression strength P is calculated from the key depression velocity V, for example, by using the following formula (S14)

$P \leftarrow K' \cdot V$ (K' is a constant)

Subsequently, a specified waveform signal is obtained from a key number and the key depression strength P, the waveform signal is transmitted to the electronic sound source 5, and sound is emitted from the loudspeaker 6 (S16).

It is then determined whether or not key release is detected by the key sensors 63, 65 (S18). After OFF signal is transmitted from the key sensor 63 to the control unit 10, if another OFF signal is transmitted from the key sensor 65 to the control unit 10, it is determined that the key release is detected. If no key release is detected at step S18 (NO at S18), the process step goes back to S18. On the other hand, if the key release is detected at step S18 (YES at S18), sounding from the electronic sound source 5 is stopped (S20) and the process step goes back to S10.

The electronic upright piano 1 according to the first embodiment provides the following advantages:

(1) The wippen 15, the jack 17 and the hammer butt 18 are rotated about the respective axes in the same manner as in an acoustic upright piano. Furthermore, when the hammer butt 18 is thrust upwards by the jack 17, the hammer 23 starts rotating, and after the jack 17 leaves the hammer butt 18, the hammer 23 is moved inertially. The inertial movement of the hammer 23 is stopped by the hammer stopper 32. A let-off timing (at which the jack 17 disengages from the hammer butt 18) is the same as that in an acoustic upright piano. Consequently, the upright piano 1 can give the player a complicated key touch of an acoustic upright piano, although it is electronic.

(2) Even when at key depression the hammer 23 strikes the hammer stopper 32, no unusual sound is emitted, because the cushion material 32*a* is interposed between the hammer and the hammer stopper.

(3) The electronic upright piano is provided with the same heavy interior decorating atmosphere and appearance as an acoustic upright piano.

(4) The electronic upright piano requires no string, or weight members such as metal frames or columns for supporting strings, and thus reduces weight and cost, different from an acoustic upright piano.

(5) The electronic upright piano 1 can be easily manufactured just by mounting the key bed unit U1 and the rear plate unit U2 to the cabinet C as shown in FIG. 5. Therefore, the electronic upright piano is suitable for mass production with reduced cost.

Figure 12:
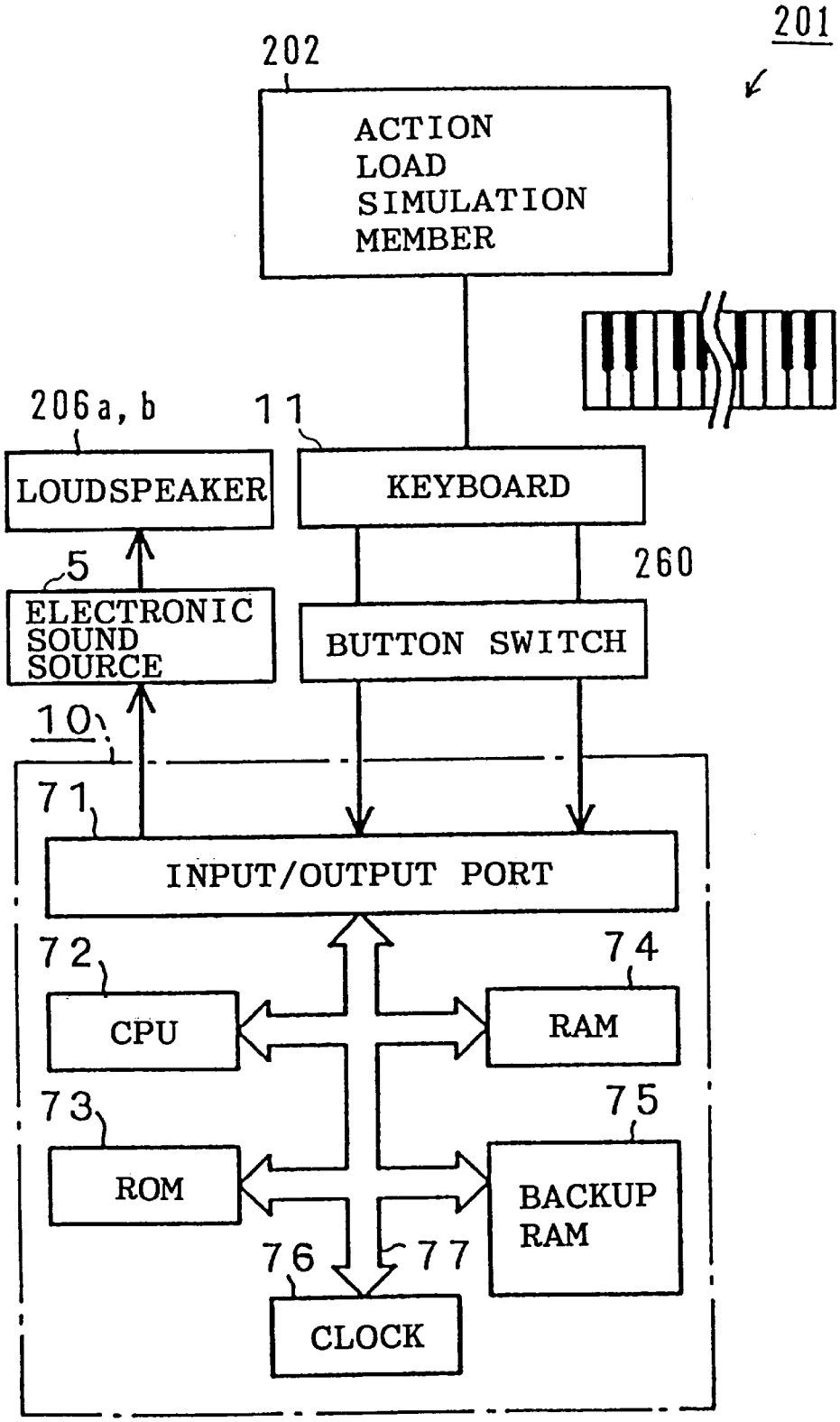
FIG. 12 is a diagrammatic representation of an electronic upright piano according to the second embodiment.
Figure 13:
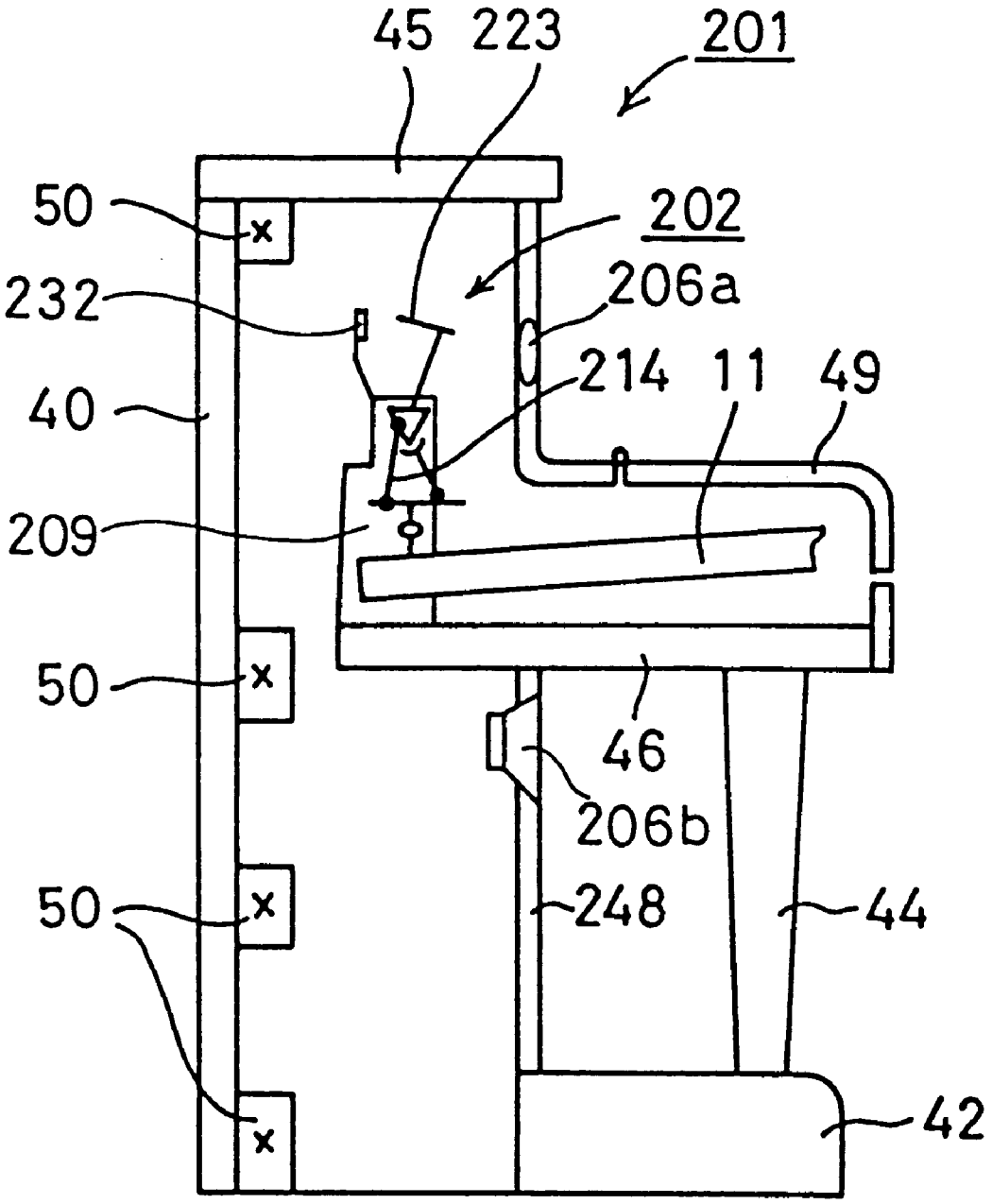
FIG. 13 is an elevated cross sectional view of the electronic upright piano of the second embodiment.
Figure 14:
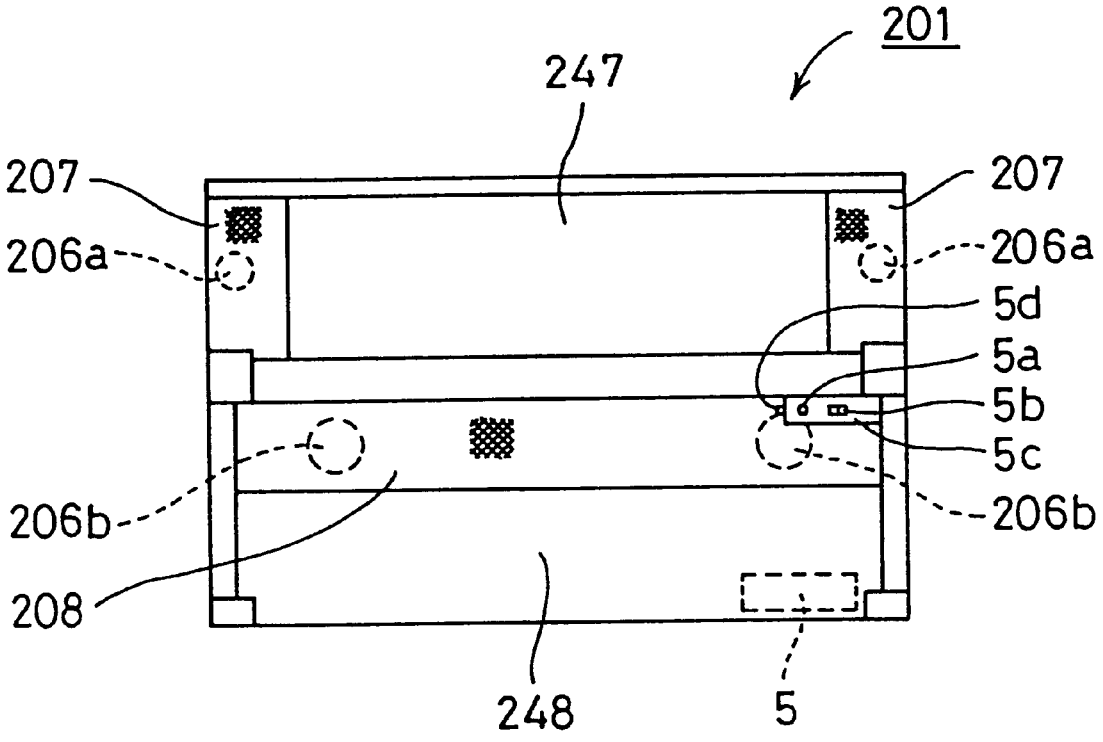
FIG. 14 is a front view of the electronic upright piano of the second embodiment.
Figure 15:
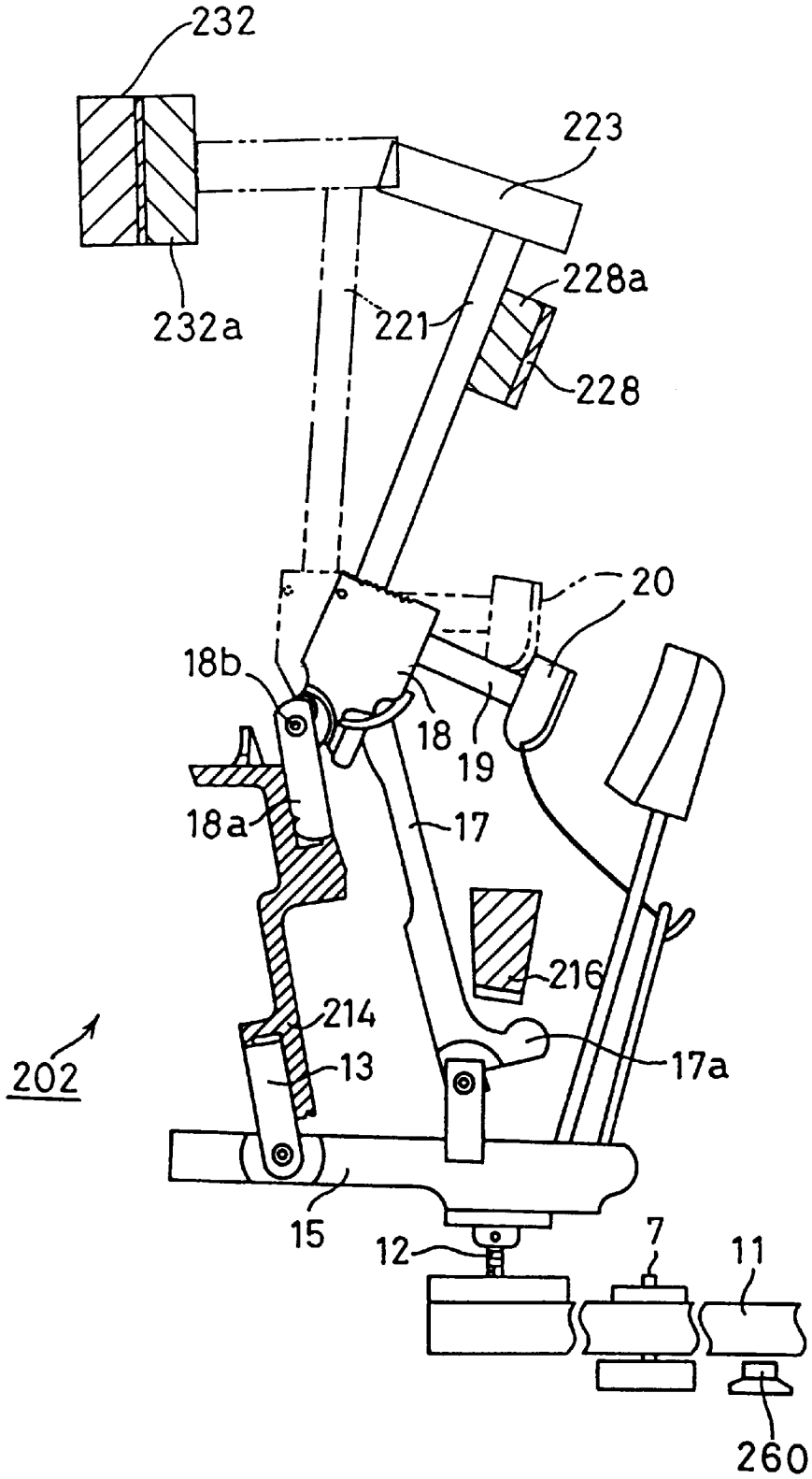
FIG. 15 is an explanatory view of an action load simulation member of the second embodiment.
Figure 16:
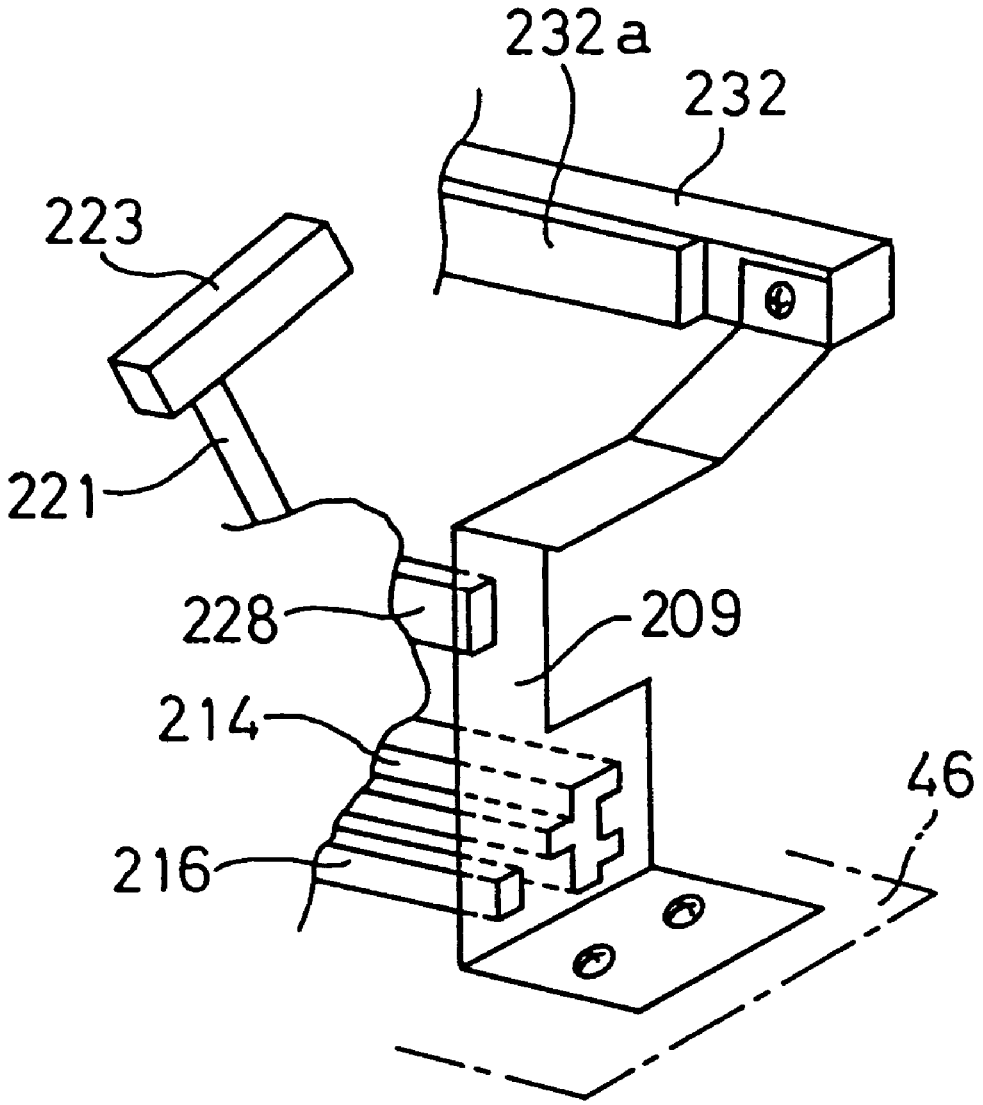
FIG. 16 is an explanatory view of the action load simulation member of the second embodiment.

A second embodiment is now explained. FIG. 12 is a diagrammatic representation of an electronic upright piano according to the second embodiment, FIG. 13 is an elevated cross sectional view thereof, FIG. 14 is a front view thereof, and FIGS. 15 and 16 are explanatory views of an action load simulation member of the second embodiment. In the second embodiment, since the composing elements having the same reference numbers as those of the first embodiment are identical in function to the corresponding elements of the first embodiment, they are not explained for simplicity.

In the second embodiment, as shown in FIG. 12, an electronic upright piano 201 is provided with an action load simulation member 202, keys 11, a button switch 260, control unit 10, electronic sound source 5, and loudspeakers 206*a*, 206*b*.

The action load simulation member 202 is, as shown in FIG. 15, provided with wippen 15, a regulating rail 216, jack 17, hammer butt 18 and a hammer shank 221 having a hammer 223, and with the catcher shank 19 having the catcher 20. The action load simulation member 202 is, as shown in FIG. 16, supported by a pair of support members 209 (only one thereof is shown in FIG. 16) secured with screw bolts on the key bed 46 at both sides of the piano 201. A stopper rail 232 is extended above the support members 209, and a center rail 214, the regulating rail 216 and a hammer rail 228 are extended between the support members. As shown in FIG. 15, the wippen 15 and the hammer butt 18 are rotatably attached via the flange 13 and the butt flange 18*a*, respectively, to the center rail 214, the jack 17 is rotatably attached to the wippen 15, and the hammer shank 221 and the catcher shank 19 are secured to the hammer butt 18. The regulating rail 216 corresponds to the regulating button and is provided with a felt material on the underside of the rail 216. In the same manner as the hammer stopper 32 of the first embodiment, the stopper rail 232 stops the hammer 223 at a string striking position, and is provided with a felt material 232*a* on its face opposing to the hammer 223. The hammer 223 is formed of acrylic resin in almost a rectangular parallelopiped, and has a larger specific weight than a hammer made of wood. Although the hammer 223 has the same weight as the corresponding wood hammer, it has a more compact structure including the hammer shank 221.

As shown in FIG. 15, the button switch 260 is opposed to the underside of the key 11, and is provided with two switches inside. When the key 11 is depressed, one of the inner switches is turned on, transmitting an ON signal, and afterwards if another key 11 is depressed, the other inner switch is turned on, transmitting an ON signal. The button switch 260 replaces the key sensors 63, 65 of the first embodiment, and is also connected to the control unit 10.

As shown in FIG. 14, the electronic sound source 5 is secured on the inner bottom face of the electronic upright piano. A control box 5*c* for the electronic sound source 5 provided with a power switch 5*a* and a volume switch 5*b* is secured under the key bed 46, The control box 5*c* is further provided with a headphone terminal 5*d*. By connecting a headphone jack to the headphone terminal 5*d*, sound is emitted to the headphone, and the loudspeakers emits no sound. The loudspeakers 206*a* of medium and high tone are provided on opposite sides of an upper frame 247 and are covered with upper nets 207, respectively. The loudspeaker 206*b* of low tone is provided on opposite sides above a bottom frame 248 and is covered with a lower net 208.

Figure 17:
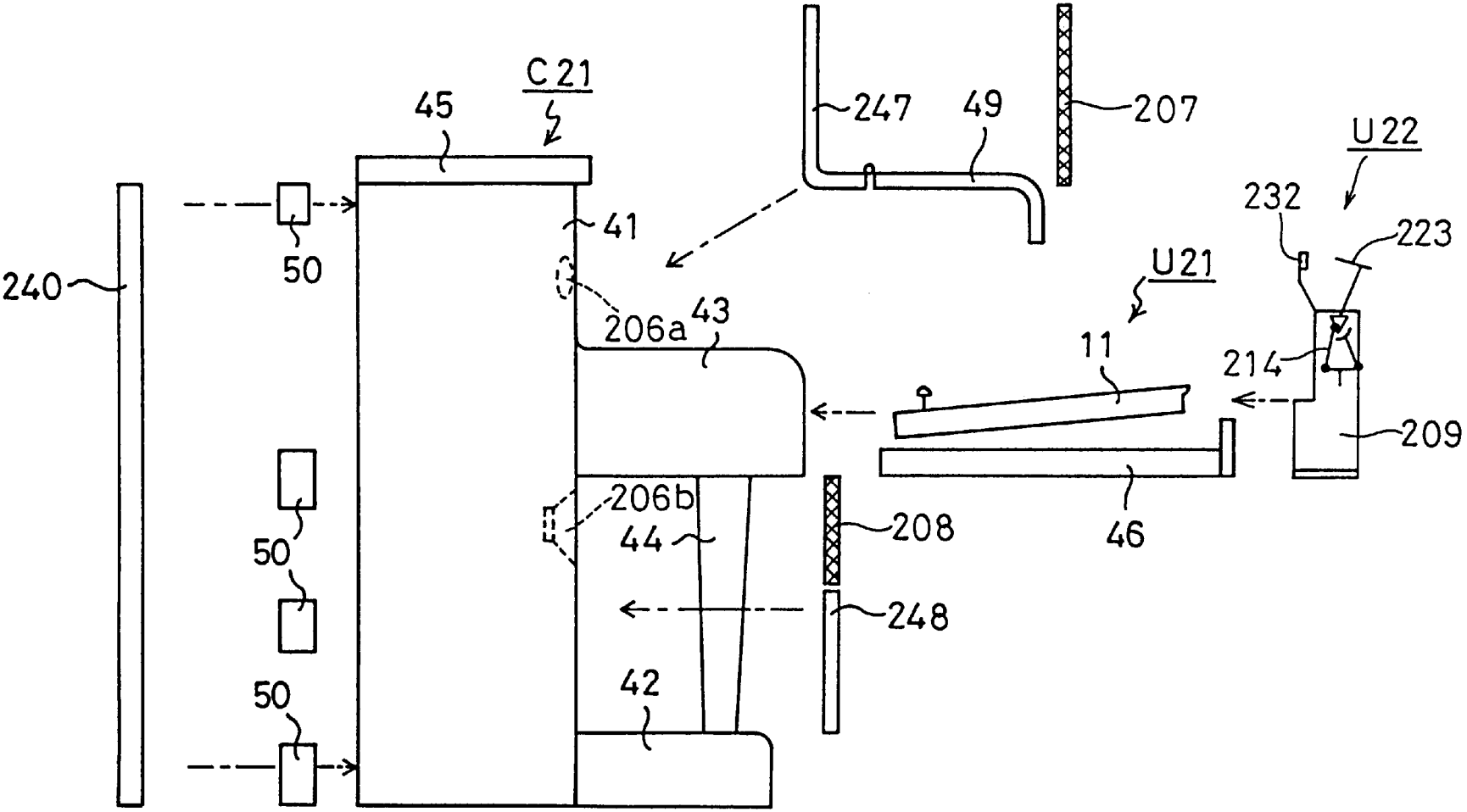
FIG. 17 is an explanatory view showing the assembly of the electronic upright piano of the second embodiment.

When assembling the electronic upright piano 201, as shown in FIG. 17, first the toe blocks 42, the arms 43, the legs 44 and a rear plate 240 are attached to the opposite end panels 41, respectively. The loudspeakers 206*a* and 206*b* are also attached to predetermined positions. A cabinet C21 is completed. On the other hand, a key frame (not shown) with the button switch 260 and other associated components attached thereto, the keys 11 and the key bed 46 are integrally assembled to form a key bed unit U21. The key bed unit U21 is secured to L-shaped fasteners (not shown) secured to the opposite arms 43, and cheek blocks (not shown) are mounted. Subsequently, an action unit U22 (an assembly of the components of action load simulation member 202 supported on the support members 209) is disposed at the rear side of the key bed unit U21. After the support members 209 are secured to the key board 46, the upper frame 247, the upper nets 207, the lower net 208 and the like are mounted, thereby forming the electronic upright piano 201 of the second embodiment shown in FIG. 13.

The operation of the electronic upright piano 201 of the second embodiment is the same as that of the electronic upright piano 1 of the first embodiment, except that the depression or the release of key 11 is detected by the button switch 260, instead of the key sensors 63, 65 of the first embodiment. Therefore, the operation of the second embodiment is omitted. The electronic upright piano 201 can provide the same advantages as those of the first embodiment, except for the aforementioned (5), and an additional advantage. Conventionally, the action mechanism is formed by assembling separate components, such that the structure of the action mechanism is strengthened. Such assembly of the action mechanism requires much labor. However, in the second embodiment, the action load simulation member 202 (the action mechanism) need not be especially firmly secured, because no string striking sound need not be emitted. Therefore, the action unit U22 can be used, instead of assembling the separate components. Therefore, the second embodiment obviates the necessity of carrying out an intricate assembly work to provide a key touch of an acoustic upright piano, thereby achieving the mass production and reducing the production cost.

Figure 18A:
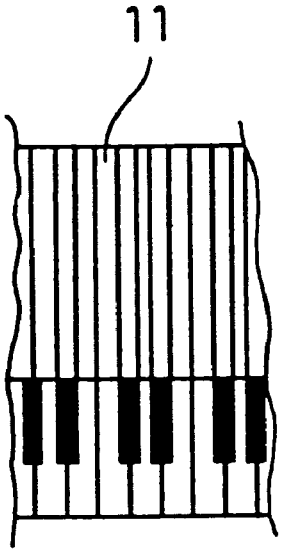
FIG. 18 is an explanatory view of keys, respectively, of the first and second embodiments and the prior art.
Figure 18B:
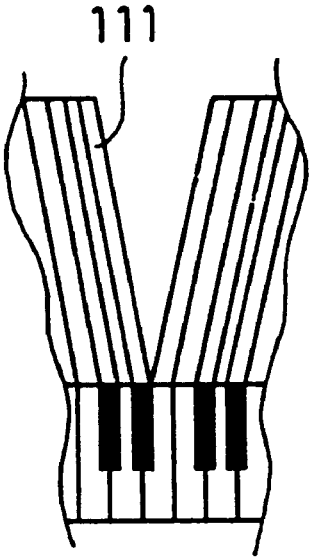

As shown in FIG. 18, the keys 111 of the conventional upright piano (FIG. 18(*b*)) cannot be straightly formed and need to be folded halfway because supporting frames and columns need to be disposed. The keys 11 of the first and second embodiments (FIG. 18(*a*)) can be formed like straight bars since no supporting frames or columns is necessary, obviating the conventional step of dividing the keys in folded shapes. The keys 11 can be formed of wood, or of acrylic resin or other plastic material.

This invention is not limited to the aforementioned embodiments, and is intended to include all modifications and alterations within the technical scope of the invention.

For example, in the first embodiment, the hammer stopper 32 can be replaced by a hammer shank stop rail for contacting and stopping the hammer shank 21, or by a catcher stopper for contacting and stopping the catcher 20.

Figure 7A:
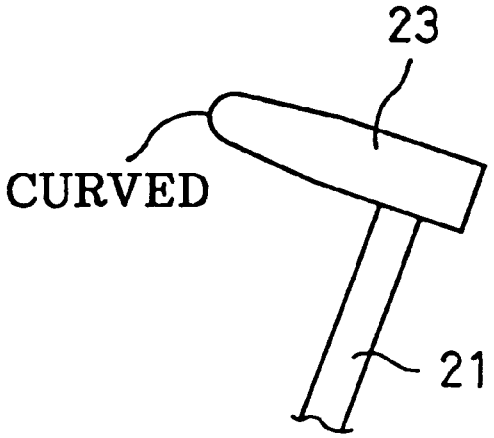
FIG. 7 is an explanatory view of modified hammer parts.
Figure 7B:
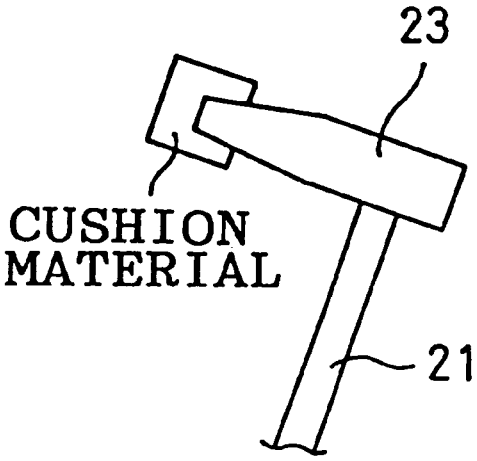

As shown in FIG. 7(*a*), the tip of the hammer 23 can be curved (have a radius), thereby having an enlarged contact area, and enhancing the cushioning effect of the cushion material 32*a* and increasing the durability of the cushion material 32*a*. As shown in FIG. 7(*b*), a cushion material, replacing the cushion material 32*a* of hammer stopper 32, can be attached to the tip of the hammer 23.

Figure 8:
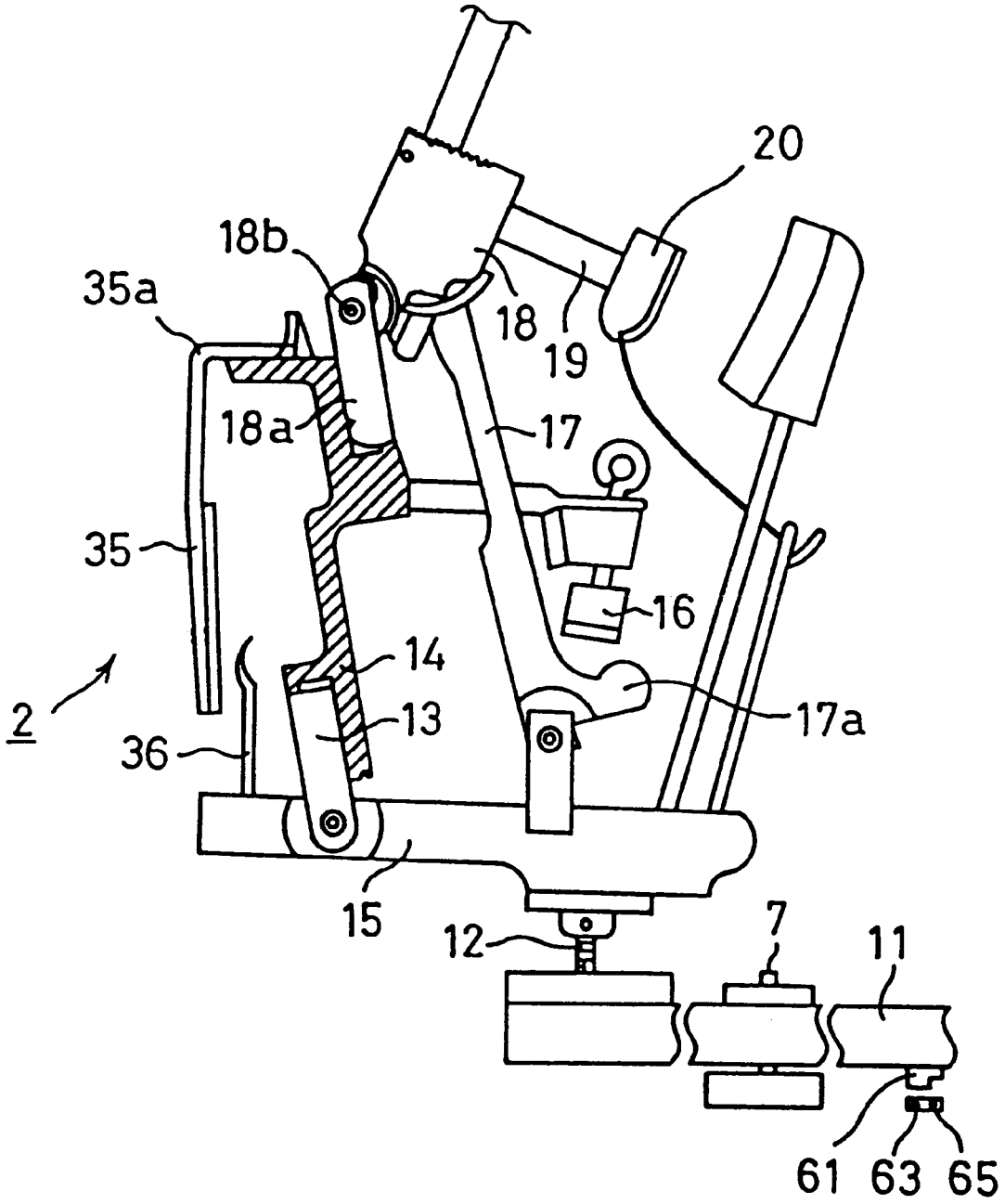
FIG. 8 is an explanatory view of modified action load simulation member.
Figure 9:
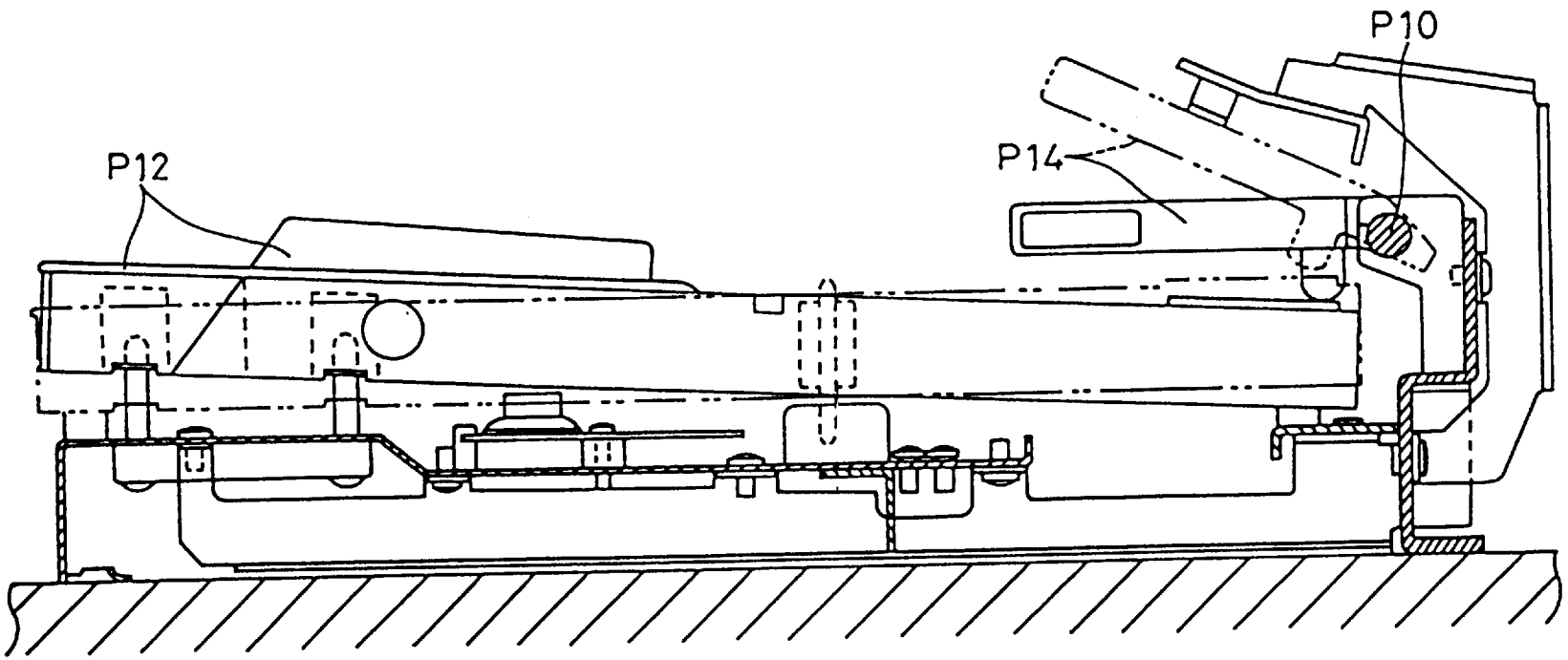
FIG. 9 PRIOR ART
FIG. 9 is an explanatory view of a conventional action load simulation member.
Figure 10:
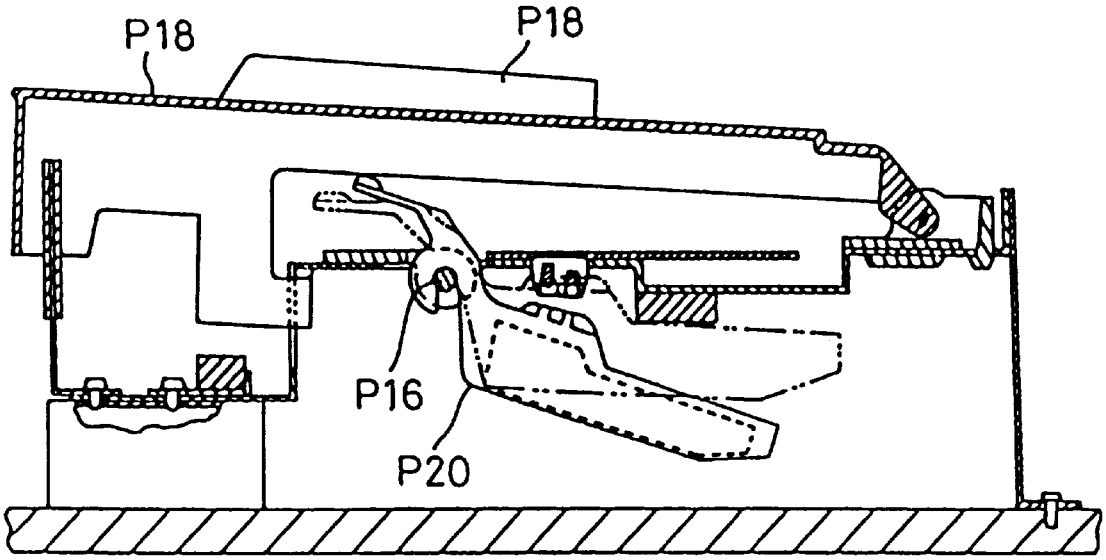
FIG. 10 PRIOR ART
FIG. 10 is an explanatory view of another conventional action load simulation member.
Figure 11:
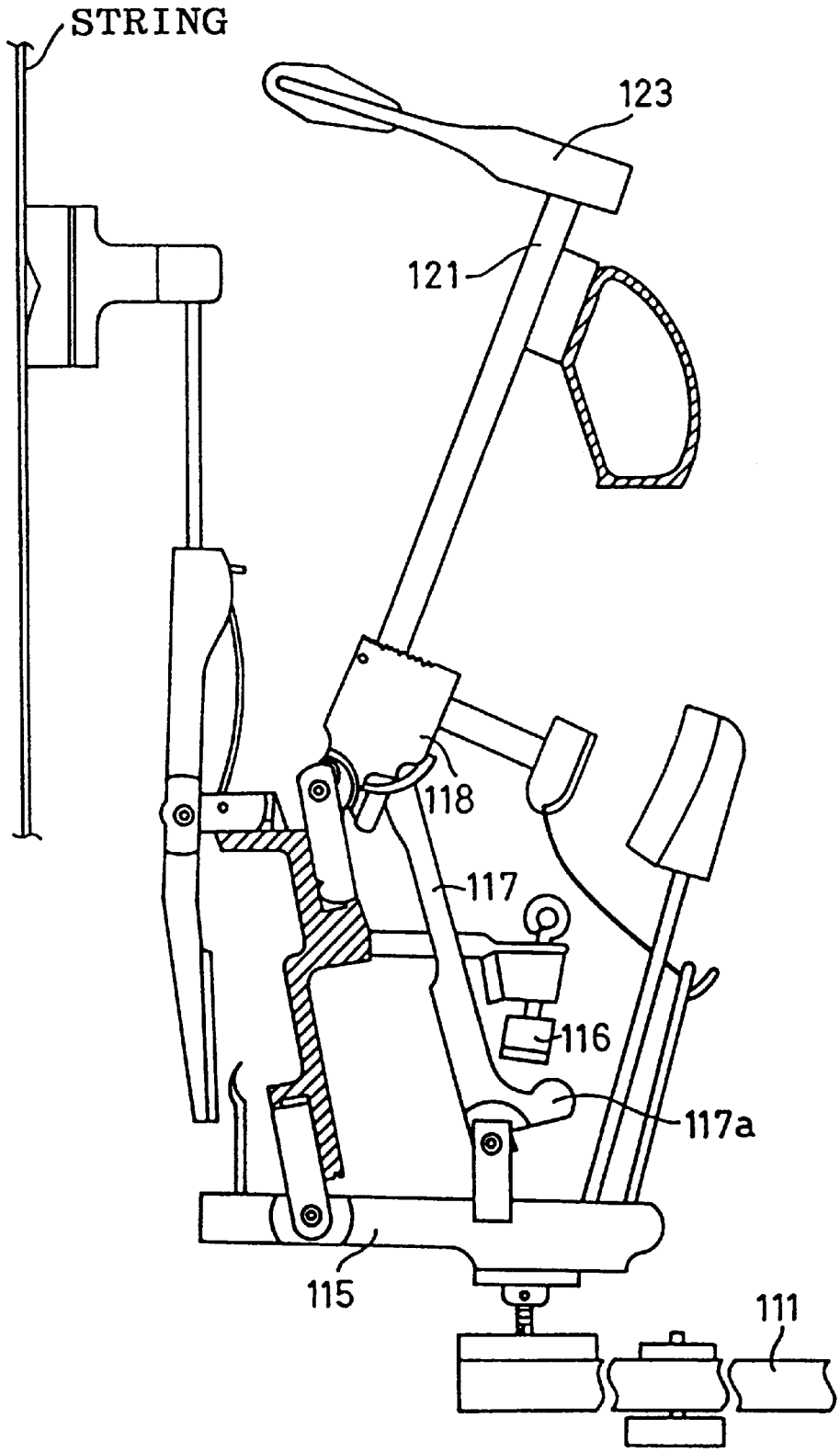
FIG. 11 is an explanatory view of an action mechanism in an acoustic piano.

In addition, as shown in FIG. 8, an L-shaped member 35 can be attached to the center rail 14, and a spoon-like member 36 (pushing member) can be attached to the wippen 15 so as to be opposed via the flange 13 to the jack 17. The "L" shaped member 35 has a resilient bent portion 35*a*. These members 35 and 36 correspond to a damper member. When the key 11 is depressed, the wippen 15 is rotated, and the spoon-like member 36 contacts the L-shaped member 35. Subsequently, when the wippen 15 is further rotated, a load applied on the key 11 is slightly increased because the spoon-like member 36 continues pushing the member 35. Therefore, the members 35 and 36 can provide the damping effect as in an acoustic upright piano and can produce a key touch of an acoustic piano.

In the second embodiment, the key bed unit U21 and the action unit U22 can be assembled beforehand. Subsequently, the assembly of the units 21, 22 can be secured to fasteners (not shown) of the arms 43 of cabinet C21. After mounting cheek blocks (not shown), the upper frame 247, the upper nets 207, the lower net 208 and the like are mounted, thereby constructing the electronic upright piano 201 shown in FIG. 13.

What is claimed is:

1. An electronic upright piano provided with an integrated action unit, said integrated action unit comprising:

two support members;

a center rail disposed between said two support members;

a plurality of action load simulation members supported by said center rail, each of said action load simulation members comprising:

a wippen equivalent member rotatably attached to said center rail for rotating when a player depresses a key and the key is rotated;

a jack equivalent member rotatably attached to said wippen equivalent member for rising when in responsive to a key depression said wippen equivalent member is rotated; and a hammer equivalent member, rotatably coupled to said center rail, for being pushed up and rotated by said jack equivalent member while said jack equivalent member is rising to a predetermined position, and for leaving said jack equivalent member and moving inertially after said jack equivalent member reaches the predetermined position; and at least one stopper, supported by said two support members, for contacting said inertially moving hammer equivalent member, thereby stopping the inertial movement of said hammer equivalent member;

whereby said integrated action unit is able to be assembled or manufactured as an integrated, separate unit for improved manufacturing efficiency and quick installation into said electronic piano.

2. An electronic upright piano as claimed in claim 1, wherein said hammer equivalent member comprises:

a butt part rotatably attached to said center rail for contacting or leaving said jack equivalent member;

a bar-like hammer shank part connected to said butt part; and a hammer part attached to said hammer shank part.

3. An electronic upright piano as claimed in claim 2, wherein said at least one stopper is brought into contact with said hammer equivalent member via a cushion material.

4. An electronic upright piano as claimed in claim 2, wherein said electronic upright piano is provided with an acoustic upright piano case.

5. An electronic upright piano as claimed in claim 1, wherein said at least one stopper is brought in contact via a cushion material with said hammer equivalent member.

6. An electronic upright piano as claimed in claim 5, wherein said electronic upright piano is provided with an acoustic upright piano case.

7. An electronic upright piano as claimed in claim 1, provided with an acoustic upright piano case.

8. The electronic upright piano of claim 1 wherein said at least one stopper is a stopper rail.

9. A method of manufacturing an electronic upright piano having a plurality of action load simulation members for applying an action simulating load onto a keyboard, said method comprising the steps of:

assembling a cabinet comprising a pair of toe blocks, a pair of arms and a pair of legs, a rear plate, a top cover, two end panels and at least a pair of speakers;

securing a key bed comprising a plurality of piano keys to the cabinet;

attaching an action unit having said plurality of action load simulation members integrally assembled thereon, to a rear portion of the key bed, said action load simulation members comprising:

a wippen equivalent member rotatably connected to an action unit center rail for rotating when a player depresses a key and the key is rotated;

a jack equivalent member rotatably attached to said wippen equivalent member for rising in response to a key depression and said wippen equivalent member is rotated;

a hammer equivalent member being in contact with pushed up and rotated by said jack equivalent member while said jack equivalent member is rising to a predetermined position, the hammer equivalent member leaving said jack equivalent member and moving inertially after said jack equivalent member reaches the predetermined position;

a stopper for arresting said inertially moving at least one hammer equivalent member, thereby stopping the inertial movement of said hammer equivalent member;

whereby, instead of having to attach each of said plurality of action load simulation members directly to a piano case or cabinet, said action unit, already assembled, may be quickly and efficiently attached to said key bed inside said piano cabinet; and mounting an upper frame, an upper net, and a lower net onto the cabinet to form the electronic upright piano.

10. An electronic upright piano having a cabinet encasing an integrated action unit, said integrated action unit comprising:

two end support members being spaced from one another, each support member having a first end connected to the cabinet, a middle portion and a second free end separated from the cabinet;

a center rail disposed and extending between the middle portions of said two support members;

a plurality of action load simulation members supported by said center rail, each of said action load simulation members comprising:

a wippen equivalent member rotatably attached to said center rail and linked to a piano key for rotating when the key is depressed;

a jack equivalent member rotatably attached to said wippen equivalent member for rising in response to rotation of said wippen equivalent member when the key is depressed; and a hammer equivalent member, rotatably coupled to said center rail and initially contacting said jack equivalent member, for being pushed up and rotated by said jack equivalent member while said jack equivalent member is rising to a predetermined position, the hammer leaves said jack equivalent member and moves inertially after said jack equivalent member reaches the predetermined position; and at least one stopper, separated from the cabinet and supported between the second free ends of the two end support members, is disposed to arrest the movement of said inertially moving hammer equivalent member and suppress undesirable resonance of the cabinet occurring as a result of the hammer equivalent member and stopper impact;

whereby said integrated action unit, including said at least one stopper, is able to be assembled or manufactured as an integrated, separate unit for improved manufacturing efficiency and quick installation into said electronic piano via solely the attachment of said first ends of said end supports to said cabinet.

* * * * *